US006435304B1

(12) United States Patent
Stierle

(10) Patent No.: US 6,435,304 B1
(45) Date of Patent: Aug. 20, 2002

(54) LADDER BAG

(76) Inventor: Jason R. Stierle, 18 W. 120 Kirkland La., Villa Park, IL (US) 60183

( * ) Notice: Subject to any disclaimer, the term of this patent is extended or adjusted under 35 U.S.C. 154(b) by 0 days.

(21) Appl. No.: 09/893,382

(22) Filed: Jun. 27, 2001

(51) Int. Cl.[7] ..... B65D 33/14; E04G 1/00
(52) U.S. Cl. ..... 182/129; 248/210; 206/373
(58) Field of Search ..... 182/129, 115, 182/116, 118, 107, 120, 121, 122; 248/210; 206/373

(56) References Cited

U.S. PATENT DOCUMENTS

| | | | | | |
|---|---|---|---|---|---|
| 3,937,374 | A | * | 2/1976 | Hine, Jr. | 224/32 |
| 4,274,508 | A | * | 6/1981 | Hughes et al. | 182/129 X |
| 4,356,854 | A | * | 11/1982 | McGee | 182/129 X |
| 4,383,669 | A | | 5/1983 | Rasler | |
| 4,491,258 | A | * | 1/1985 | Jones | 224/153 |
| 5,024,344 | A | * | 6/1991 | Paula | 220/9.3 |
| 5,542,553 | A | * | 8/1996 | Penniman | 211/70.6 |
| 5,547,080 | A | * | 8/1996 | Klimas | 206/373 |
| 5,603,405 | A | * | 2/1997 | Smith | 206/373 |
| 5,639,003 | A | | 6/1997 | Utzinger, III | |
| 5,647,453 | A | | 7/1997 | Cassells | |
| 5,740,883 | A | | 4/1998 | Trank | |
| 5,749,437 | A | | 5/1998 | Weller | |
| 5,813,530 | A | * | 9/1998 | Kornblatt | 182/129 X |
| 5,971,101 | A | * | 10/1999 | Taggart | 182/129 |
| 5,988,383 | A | * | 11/1999 | Armstrong | 182/129 X |
| 6,116,419 | A | * | 9/2000 | Campagna et al. | 182/129 X |
| 2001/0030142 | A1 | * | 10/2001 | Baker et al. | 206/599 |

OTHER PUBLICATIONS

Excerpt from Web Site found at www.plasticbuckle.com.

* cited by examiner

*Primary Examiner*—Bruce A. Lev
(74) *Attorney, Agent, or Firm*—Robert F. Kemp; John G. Premo

(57) ABSTRACT

A tool bag for use with scaffolding and ladders having rails and rungs. The bag is constructed of soft fabric. It has a front, back, sides and an open top. It is sized to fit between the rails of a ladder. The bag is fitted with vertically oriented open bottom, closed top sleeves attached to the sides of the bag. The sleeves are dimensioned to slide over the top rails of a ladder. The bag on its back has fastened on to it a pair of vertical hooks spaced to engage a rung of the ladder. The bag, in a preferred embodiment, has sleeves with horizontally positioned loose tool holding bands. The back and bottom of the bag may contain stiffening panels. Located between the hooks is an adjustable safety strap.

8 Claims, 2 Drawing Sheets

LADDER BAG

BACKGROUND OF THE INVENTION

1. Field of the Invention

The invention relates to the field of portable tool carrying devices. More specifically, the invention is concerned with portable tool carrying devices that can be releasably attached to the rungs and top ends of rails of a ladder and the horizontal bars or rails of scaffolding.

2. Description of the Prior Art

People who engage in construction and repair of various buildings, dwellings, and other structures frequently employ ladders and scaffolding to support them above a floor or ground surface in order to gain access to a particular portion or component of the structure. One of the more popular means of achieving the desired elevation involves the use of extension-type ladders. These ladders are a construction of two straight ladder sections that are telescopically attached in order that the ladder can be adjusted or extended to various lengths to accommodate various work heights. One ladder section, which rests upon the ground or floor surface and supports a second ladder section against a structure, is fitted with gripping feet at the unattached end of its rails. The second ladder section is sometimes fitted with tips at the unattached end of its rails to prevent scratching, damage, gouging, or otherwise marring the surface against which it is positioned.

Scaffolding is used, as are ladders, to reach high places on existing structures or those under construction. Scaffolding is sometimes vertically moveable by means of ropes and pulleys. Other types are often a grid or framework assembled on a job site and then positioned against a structure. Scaffolding has the advantage of allowing users to have more freedom to move about and it does not have to be repositioned once assembled. It has in the area of use horizontal pieces or rails.

Usually, a series of tools must be transported to the particular work location at some point on the ladder. The quantity and amount of these tools must be sufficient to accomplish the task at hand without necessitating an inordinate number of dismounts and mounts upon the ladder to acquire additional tools. The tools are usually carried upon the ladder by a tool belt, which is strapped around the waist of the wearer. As needed, the tools are accessed from and returned to various pockets and pouches within the tool belt. Such a tool belt is cumbersome and unwieldy to use. It is sometimes difficult to access or return a tool to the tool belt when the user's body position is awkward.

This limitation is frequently overcome by removing the belt and positioning it upon or over a ladder rail, a rung or a section of scaffolding. While this alternative allows easier access to the tools, it also increases the likelihood that individual tools or even the complete tool belt will be dropped or knocked off the ladder or scaffolding. Such an event requires that time and effort be expended to retrieve the dropped tool(s) or tool belt. Also, dropped tools or tool belts are safety hazard, as falling tools or a tool belt may strike a worker or passerby or cause damage to personal property.

What is needed then to overcome the problems of transporting tools by a tool belt or similar means upon a ladder or scaffolding is the provision of a tool pouch that is designed to be releasably and firmly attached to scaffolding or an extension ladder, such as the top ends of the rails of an upper ladder section or upon a ladder rung. Such a pouch would be capable of safely storing a variety of tools and at the same time making them easily accessible. This pouch should be incapable of damaging and should protect the surface against which an extension ladder rests when the pouch is secured to the top end of the ladder.

Numerous designs for ladder pouches have been provided in the prior art. Even though these designs may be suitable for the specific individual purposes to which they address, they would not be suitable for the purposes of the present invention. These prior art designs are primarily for use with pivoting stepladders. They are not particularly suited for safe use on scaffoldings. These designs are exemplified by: U.S. Pat. No. 4,383,669, Invertible Dual Carrier For Ladder Top Use, issued to Rasler, on May 17, 1983; U.S. Pat. No. 5,639,003, Convertible Ladder Caddy Utzinger, III, on Jun. 17, 1997; U.S. Pat. No. 5,647,453, Multi-Purpose Ladder Apron, issued to Cassells, on Jul. 15, 1997; U.S. Pat. No. 5,740,883, Tool Accessory For Ladder, issued to Trank, on Apr. 12, 1998; and U.S. Pat. No. 5,749,437, Free Standing Ladder Supported Tool Holder, issued to Weller, on May 12, 1998.

There is a continuing need for a new and improved ladder pouch designed primarily for use with extension-type ladders and scaffolding with means to stow a variety of tools. Further, the pouch should not damage and should protect a surface against which top of a ladder is positioned. Finally, the tool pouch, if used with scaffolding, should be capable of being securely fastened to the horizontal members of scaffolding. The present invention substantially departs from the conventional concepts and designs of the prior art, and in so doing provides a tool pouch that substantially fulfills these needs.

SUMMARY OF THE INVENTION

The present invention provides a tool bag for use with scaffolding and ladders. These ladders have rails and rungs with the top of the rails extending beyond the top rung. The tool bag, hereinafter called the bag, is a soft fabric bag having a front, back, sides and an open top. It is sized to fit between the rails of a ladder which distance in a typical extension ladder is about 13 inches.

The bag has vertically oriented open bottom, closed top sleeves attached to the sides of the bag. These sleeves are dimensioned to slide over the top rails of a ladder, which, typically in the case of some aluminum ladders, have a cross section measuring 2½ by 1 inch. There is a pair of vertical hooks affixed to the back of the bag spaced to engage a rung of the ladder, usually near the top. The hooks are desirably positioned to fall just inside the opposing sides of the rails. In the case of scaffolding, the hooks would attach to a horizontal member of the scaffold.

In another preferred embodiment, there is a loose band horizontally positioned on the outside of the sleeves that is designed to hold frequently used tools in a readily available position. In yet another preferred embodiment, the back and the bottom contains a stiffening panel, which is either externally positioned or is located between a layers of fabric forming the back and or the bottom of the bag.

The back of the bag contains an adjustable safety strap and fastener for fastening to a rung. This strap is located in the back of the bag, between the pair of vertical hooks. This safety strap prevents the bag from falling in the event the hooks are disengaged from the rung of a ladder or a horizontal member of scaffolding.

BRIEF DESCRIPTION OF THE DRAWINGS

In the drawings, like parts have like numbers

DETAILED DESCRIPTION OF THE INVENTION

Figure 1:
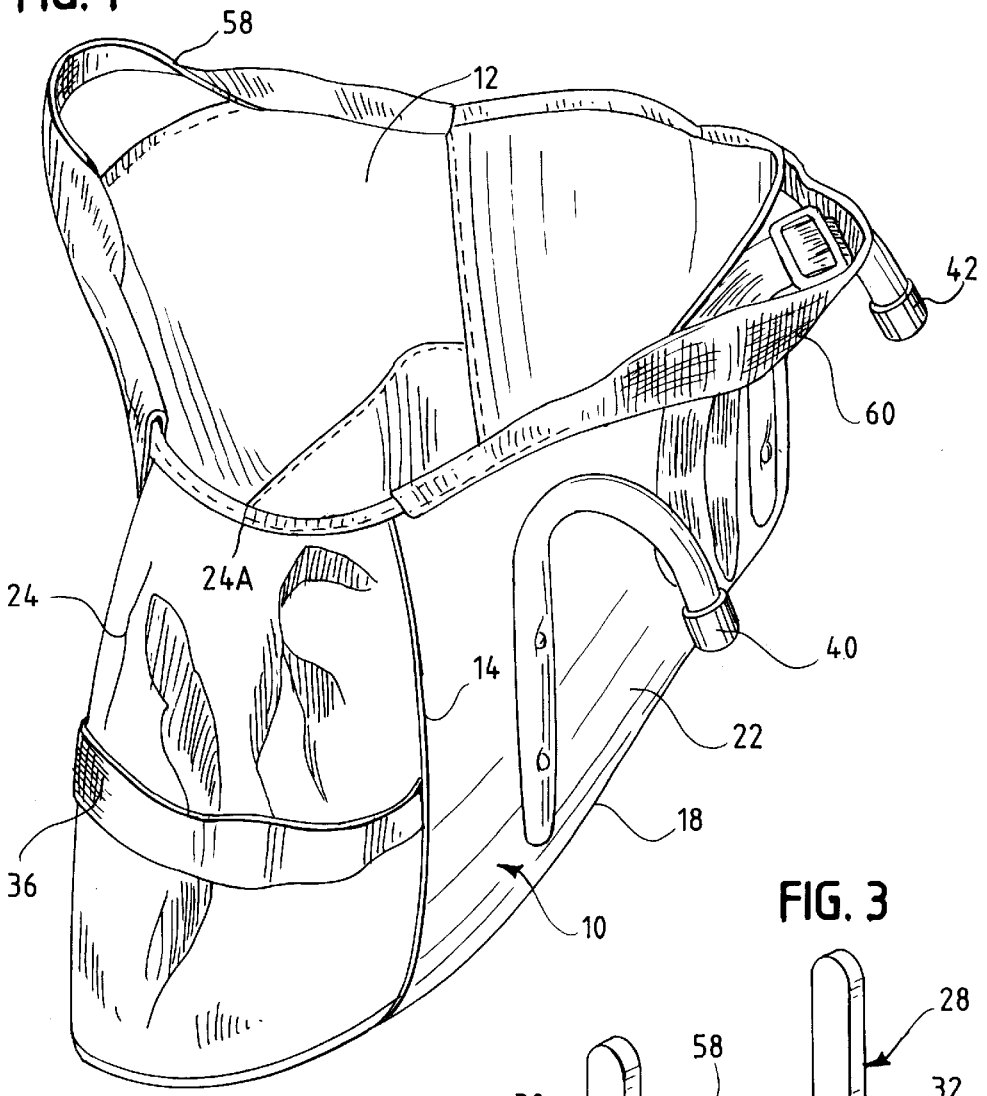
FIG. 1 is a perspective vertical back view of the tool bag.
Figure 3:
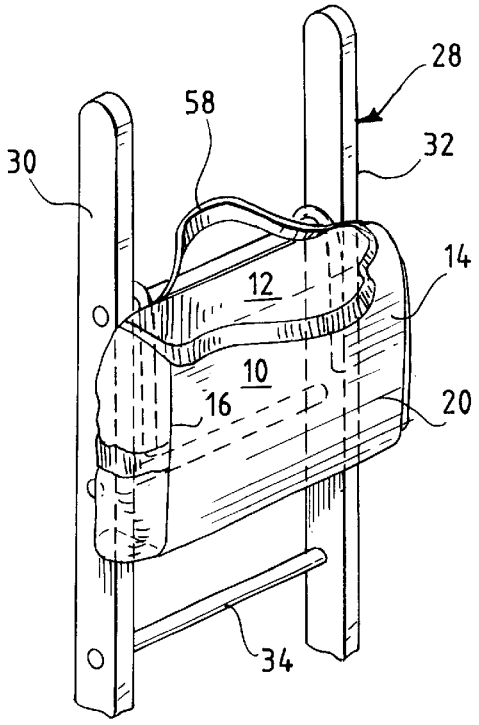
FIG. 3 is a perspective view of the tool bag hanging from the top rung of a ladder.

The bag, a soft bag, generally designated by the numeral 10, is made from a fabric, such as a heavy canvas or a synthetic heavy-duty fiber, such as nylon or acrylic fibers. The bag 10 has an open top 12, sides 14 and 16, and a bottom 18, a front 20, and a back 22. Sides 14 and 16 have vertically oriented open bottom sleeves 24 and 26, having closed tops 24A and 26A. These sleeves are dimensioned to slide over the top rails of a ladder 28. The rails of the ladder 28 are designated by the numerals 30 and 32. There are a plurality of rungs 34 positioned and supported by the rails 30 and 32.

On the outside of the vertically oriented sleeves 24 and 26, there are loose bands 36 and 38 horizontally positioned on the outside of the sleeves 24 and 26. Attached to the back 22, there is a pair of vertical spaced-apart hooks 40 and 42. The hooks 40 and 42 have at their ends non-mar plastic tips 46 and 48. Preferably, these hooks 40 and 42 are spaced as to fit closely against the rails 30 and 32. The hooks 40 and 42 are mounted by means of screws or rivets 44 to the back 22 of bag 10.

Disposed between hooks 40 and 42 and attached to the back 22 of bag 10, is safety strap 50 having a closeable, adjustable buckle 52. Typical of such closeable, adjustable fasteners such as buckles 52 are described in an advertisement for the UMX Plastic Buckle found at www.plasticbuckle.com, which is incorporated herein by reference.

Figure 4:
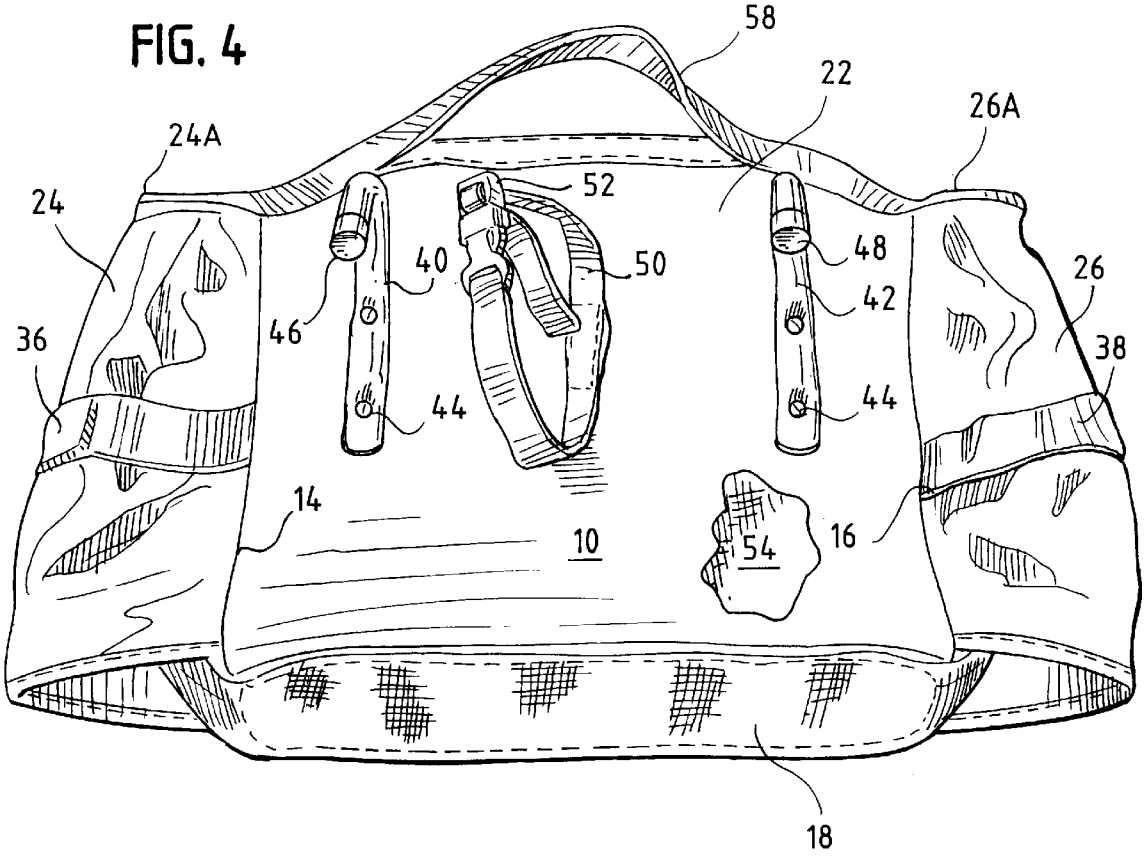
FIG. 4 is a back view of the tool bag showing hooks for rung mounting and a safety strap.
Figure 5:
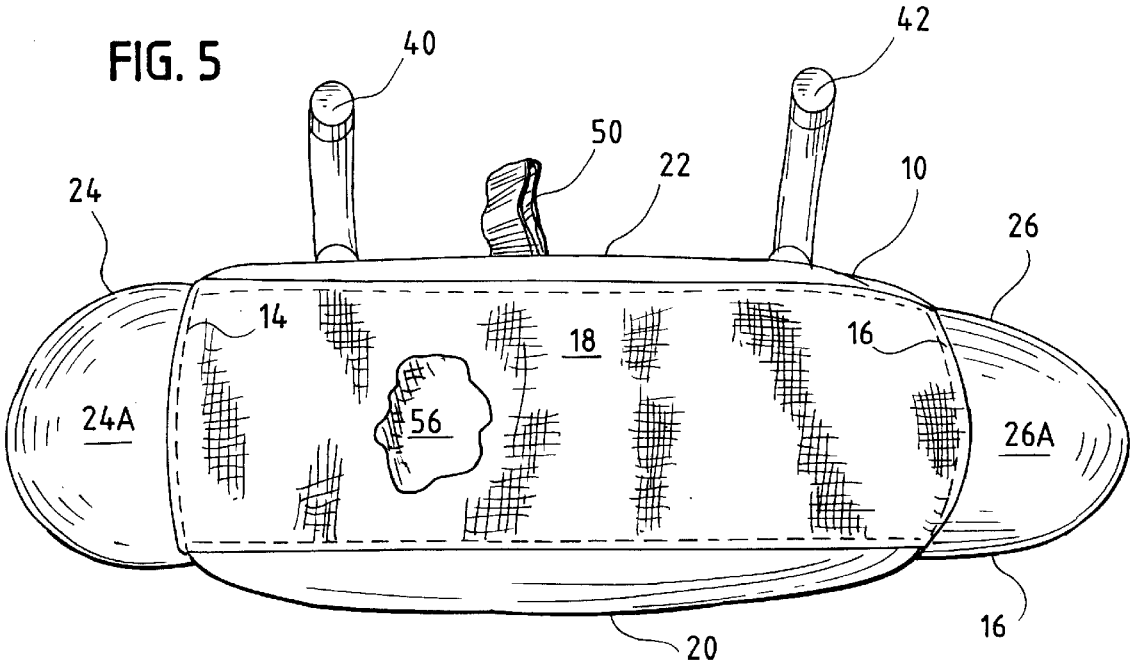
FIG. 5 is a bottom view of the tool bag corresponding to FIG. 4.

To strengthen the bag 10, so as to prevent it from sagging under the weight of tools placed therein (not shown), there is provided for back 22 a stiffening panel 54 which is constructed of thin particle board, plywood, plastic sheeting, and the like. Panel 54 may be mounted either on the inside or outside of the back 22. Desirably, it is mounted between two layers of fabric. This panel adds strength to the bag 10 and allows a more secure fastening of the hooks 40 and 42 to the back of bag 10. In a similar fashion, there is also a stiffening panel 56 located on or in the bottom 18 of bag 10. Panel 56 is also capable of being mounted on the bottom or the top of bottom 18 of bag 10. It is also beneficially mounted between layers of fabric. This preferred mounting method of the stiffening panel is illustrated in FIGS. 4 and 5. As an optional feature, the top 12 of the bag 10 may be fitted with handles 58 and 60.

Figure 2:
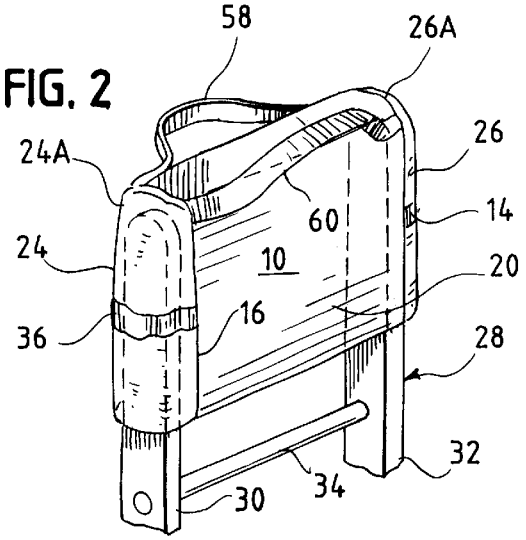
FIG. 2 is a perspective view of the tool bag mounted on the top of the rails of a ladder.

As shown to best advantage in FIG. 2, when it is necessary to mount bag 10 on the top of rails 30 and 32, the sleeves 24 and 26 are slid down upon the tops of rails 30 and 32 and are held in place by means of closed tops 24A and 26A. In this mounting position, the bag 10 is firmly held in place and makes tops of rails 30 less likely to mar surfaces against which they rest. Frequently used tools, such as a hammer, pliers, and the like (not shown), may be removed from the bag 10 and inserted into the loose bands 36 and 38. When it is desired to use the bag 10 in a lower position on the ladder 28, hooks 40 and 42 are placed over a rung 34 of ladder 28 at a position close to the area being worked upon. When scaffolding is being used, hooks 40 and 42 are place on a horizontal member near the work area. To ensure that the bag 10 does not accidentally become disengaged from a rung 34 or scaffolding horizontal member (not shown), the safety strap 50 is placed around the rung 34 engaged by hooks 40 and 42, fastened by means of a closeable,

Having thus described my invention, I claim as follows: I claim:

1. A tool bag for use with scaffolding and ladders having rails and rungs with the top of the rails extending beyond the top rung comprising:

a soft fabric bag having a front, back, sides and an open top sized to fit between the rails of a ladder;

vertically oriented sleeves having an open bottom and a closed top attached to the sides of the bag dimensioned to slide over the top rails of a ladder;

a pair of vertical hooks affixed to the back of the bag spaced to engage a rung of the ladder.

2. The bag of claim 1, where there is a loose band horizontally positioned on the outside of the sleeves.

3. The bag of claim 1, where the back contains a stiffening panel.

4. The bag of claim 1, where the bottom contains a stiffening panel.

5. The bag of claim 1, where the back and the bottom contain a stiffening panel.

6. The bag of claim 1, where the back contains a rung attachable safety strap.

7. The bag of claim 6 where the safety strap is located in the back of the bag between the pair of vertical hooks.

8. The bag of claim 7, where the safety strap is adjustable.

* * * * *